US011988442B2

(12) United States Patent
Kwon et al.

(10) Patent No.: US 11,988,442 B2
(45) Date of Patent: May 21, 2024

(54) REFRIGERATOR

(71) Applicant: LG Electronics Inc., Seoul (KR)

(72) Inventors: Hyuckjin Kwon, Seoul (KR); Daham Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 205 days.

(21) Appl. No.: 17/368,025

(22) Filed: Jul. 6, 2021

(65) Prior Publication Data

US 2022/0003494 A1 Jan. 6, 2022

(30) Foreign Application Priority Data

Jul. 6, 2020 (KR) ..... 10-2020-0082767

(51) Int. Cl.

| | |
|---|---|
| ***F25D 11/02*** | (2006.01) |
| ***F25D 23/02*** | (2006.01) |
| ***F25D 23/06*** | (2006.01) |
| ***F25D 25/00*** | (2006.01) |
| ***F25D 27/00*** | (2006.01) |
| ***F25D 29/00*** | (2006.01) |

(52) U.S. Cl.

CPC ..... *F25D 29/003* (2013.01); *F25D 11/02* (2013.01); *F25D 23/028* (2013.01); *F25D 23/066* (2013.01); *F25D 23/069* (2013.01); *F25D 25/005* (2013.01); *F25D 27/005* (2013.01); *F25D 29/005* (2013.01); *F25D 2201/10* (2013.01); *F25D 2700/00* (2013.01)

(58) Field of Classification Search

CPC .... F25D 11/02; F25D 2201/10; F25D 23/025; F25D 23/028; F25D 23/066; F25D 23/069; F25D 25/005; F25D 27/005; F25D 2700/00; F25D 2700/04; F25D 29/003; F25D 29/005

See application file for complete search history.

(56) References Cited

U.S. PATENT DOCUMENTS

| | | | | |
|---|---|---|---|---|
| 9,252,570 | B2 * | 2/2016 | Allard | H02B 1/20 |
| 9,829,241 | B2 * | 11/2017 | Seo | A47F 3/043 |
| 9,991,683 | B2 * | 6/2018 | Allard | F25D 17/042 |

(Continued)

FOREIGN PATENT DOCUMENTS

KR 1020170082095 7/2017

OTHER PUBLICATIONS

Extended European Search Report in European Appln. No. 21183735.6, dated Nov. 30, 2021, 8 pages.

*Primary Examiner* — Filip Zec
(74) *Attorney, Agent, or Firm* — Fish & Richardson P.C.

(57) ABSTRACT

A refrigerator includes a cabinet having a storage space and a door to open and close the storage space. The door includes a panel assembly including a front panel, a door frame connected to the panel assembly, a door liner connected to the panel assembly and the door frame and to define an insulating space, in which an insulator is disposed, together with the panel assembly and the door frame, and a sensor module installed on the door frame to sense a knock input applied to the front panel. The door frame includes a front wall that is in contact with the front panel and a rear wall spaced apart from the front wall and configured to define an accommodation space, in which the sensor module is accommodated, together with the front wall.

20 Claims, 9 Drawing Sheets

(56) References Cited

U.S. PATENT DOCUMENTS

| | | | | |
|---|---|---|---|---|
| 10,018,406 | B2 * | 7/2018 | Liu | B32B 3/06 |
| 10,030,905 | B2 * | 7/2018 | Allard | B29C 45/1642 |
| 10,712,069 | B2 * | 7/2020 | Bertolini | F25C 5/185 |
| 11,703,264 | B2 * | 7/2023 | Shivappa Thenehalli | F25C 5/24 62/344 |
| 2017/0191746 | A1 | 7/2017 | Seo | |
| 2019/0178568 | A1 | 6/2019 | Koo | |
| 2020/0132363 | A1 | 4/2020 | Kim et al. | |
| 2020/0278142 | A1 * | 9/2020 | Becker | F25C 1/243 |

* cited by examiner

REFRIGERATOR

CROSS-REFERENCE TO RELATED APPLICATIONS

This application claims priority under 35 U.S.C. § 119 to Korean Patent Application No. 10-2020-0082767, filed in Korea on Jul. 6, 2020, whose entire disclosure is hereby incorporated by reference.

BACKGROUND

This specification relates to a refrigerator.

In general, refrigerators are home appliances for storing foods at low temperature in an inner storage space covered by a refrigerator door. Here, the inside of the storage space is cooled using cool air that is generated by being heat-exchanged with a refrigerant circulated in a refrigeration cycle to store the foods in an optimal state.

The refrigerator may be independently placed in a kitchen or living room or may be accommodated in a space defined by a furniture cabinet or a wall of the kitchen.

The refrigerator tends to increase in size more and more, and multi-functions are provided to the refrigerator as dietary life changes and pursues high quality, and accordingly, refrigerators of various structures in consideration of user convenience are, brought to the market.

A refrigerator is disclosed in Korean Patent Publication No. 10-2017-0082095 (published on Jul. 13, 2017), which is a prior document.

The refrigerator includes a cabinet defining a storage space, a main door which opens and closes the storage space and in which an opening communicating with the storage space is defined, a sub door mounted rotatably on the main door and opening to open and close the opening, a panel assembly provided on the sub door so that the inside of the opening is selectively visible, a knock sensing device disposed on a rear surface of the panel assembly to sense user's knock manipulation of the panel assembly, and a door lighting unit provided above the panel assembly and turned on and off by the knock sensing device to illuminate an inner space of the opening so that the panel assembly is selectively transparent.

The sub door includes an outer plate made of a metal plate to define an outer appearance of the sub door and having a panel mounting hole, in which the panel assembly is mounted, a door liner spaced apart from the outer plate to define a circumference of a rear surface of the sub door and defining a space, in which an insulator is filled, outside the panel assembly, an upper cap decor coupled to upper ends of the outer plate and the door liner to define a top surface of the sub door; and a lower cap decor coupled to lower ends of the outer plate and the door liner to define a bottom surface of the sub door.

The panel assembly includes a front panel disposed in the panel mounting hole, a plurality of insulating panels spaced apart from the front panel and made of transparent tempered glass, and a spacing rod provided between the front panel, the insulating panel, the plurality of insulating panels so that the front panel, the insulating panel, and the plurality of insulating panels are spaced apart from each other and sealed therebetween.

The panel mounting hole is substantially defined to face an opening of the main door, and the knock sensing device is in contact with the rear surface of the front panel disposed in the panel mounting hole. The knock sensing device includes a microphone module that is in contact with the rear surface of the front panel to receive a sound wave generated by vibration during a knock transmitted through the front panel.

In the case of the prior art document, the knock sensing device is in contact with the rear surface of the front panel to sense the sound wave due to characteristics of the knock sensing device. Thus, even though the panel assembly defines an insulating space, and the insulator surrounds a portion of the panel assembly, cold air is directly transferred to the insulating panel. Therefore, the knock sensing device is subjected to an influence (influences of a low temperature and high humidity) of the cold air in the storage space to cause a sensing error of the knock sensing device, thereby deteriorating sensing accuracy.

SUMMARY

Embodiments provide a refrigerator that is capable of sensing a knock signal even when a sensor module is spaced apart from a front panel.

Optionally or additionally, embodiments also provide a refrigerator that prevents a sensing module for sensing a knock from being deteriorated in sensing accuracy.

Optionally or additionally, embodiments also provide a refrigerator, in which a sensor module is easily assessable when service of the sensor module is required and is capable of being easily replaced.

In one embodiment, a refrigerator includes: a cabinet having a storage space; and a door configured to open and close the storage space.

The door may include: a panel assembly including a front panel; a door frame connected to the panel assembly; a door liner connected to the panel assembly and the door frame and configured to define an insulating space, in which an insulator is disposed, together with the panel assembly and the door frame; and a sensor module installed on the door frame to sense a knock input applied to the front panel.

The door frame may include an accommodation space that is partitioned from the insulating space and defined outside the insulating space, and the sensor module may be installed on the door frame in the accommodation space.

The door frame may include a front wall that is in contact with the front panel and a rear wall spaced apart from the front wall and configured to define an accommodation space, in which the sensor module is accommodated, together with the front wall.

The front wall may include one surface facing the front panel and the other surface disposed at an opposite side of the one surface to face the rear wall, and a mounting portion, on which the sensor module is mounted, may be provided on the other surface of the front wall, and in the state in which the sensor module is mounted on the mounting portion, the sensor module may be spaced apart from the front panel by the front wall.

The front wall may include a protrusion rib protruding toward the front panel, and the protrusion rib may be in contact with a rear surface of the front panel.

A plurality of protrusion ribs may be disposed to be spaced apart from each other in a vertical direction.

The sensor module may include a sensor element and a sensor PCB on which the sensor element is installed and which is mounted on the mounting portion.

The front wall may include a through-hole that is defined to face the sensor PCB in a state in which the sensor PCB is mounted on the mounting portion.

A circumferential wall in which a hollow is defined therein may be disposed at a portion of the front wall, in which the through-hole is defined, and the circumferential wall may be in contact with the front panel.

The sensor element may be disposed to face the through-hole.

The sensor element may include an acceleration sensor configured to sense vibration generated by a knock applied to the front panel.

The mounting portion may include: a pair of extension portions extending from the other surface of the front wall; a connection portion configured to connect the pair of extension portions; and a support portion configured to support the sensor PCB between the front wall and the connection portion.

The support portion may include a seating groove in which the sensor PCB is seated. In the state in which the sensor PCB is seated in the seating groove, the sensor PCB may be in contact with the other surface of the front wall.

The mounting portion may further include a pressing rib extending from the connection portion toward and the front wall and spaced apart from the front wall.

The sensor PCB may be inserted into a gap between the front wall and the pressing rib.

The panel assembly may include an insulating panel spaced apart from the front panel, at least a portion of the gap may have a size that gradually decreases toward the insulating panel. When the sensor PCB is inserted into the gap and is seated in the seating groove, the sensor PCB may be in contact with the front wall and the pressing rib.

A surface of the pressing rib, which faces the front surface, may include an inclined surface that is inclined in a direction away from the front wall as the inclined surface is away from the insulating panel.

The front panel may include: a first portion that is capable of transmitting light and faces the storage space; and a second portion disposed outside the first portion to restrict the transmission of the light. A first part of the second portion may be disposed to face the storage space, and a second part disposed outside the first part may be disposed so as not to face the storage space. In the state in which the sensor module is mounted on the mounting portion, the sensor module may be disposed to face the second part of the second portion.

The front wall may be in contact with the second part of the second portion. The door frame may further include a connection wall configured to connect the front wall to the rear wall. One surface of the front wall and one surface of the connection wall may be configured to define the insulating space, and the other surface of the front wall and the other surface of the connection wall may be configured to define the accommodation space.

A portion of one surface of the front wall may be spaced apart from the second part of the second portion, and a portion of the insulating space may be defined between the front wall and the second part of the second portion.

The panel assembly may include an insulating panel spaced apart from the front panel, and in the state in which the sensor module is mounted on the mounting portion, a distance between the sensor module and the insulating panel may be greater than that between an outermost portion, which is disposed farthest from the insulating panel, and the insulating panel in the insulating space.

The door frame may include an opening, and the opening may be covered by the frame cover. The sensor module may be mounted on the mounting portion through the opening.

The frame cover may include a sensor pressing portion configured to press the sensor module in a state of being coupled to the door frame.

The sensor pressing portion may be configured to press the sensor PCB toward the other surface of the front wall.

The cabinet may include an inner case configured to define the storage space and an outer case disposed outside the inner case. The front wall may be disposed higher than the outer case.

In another embodiment, a refrigerator includes: a cabinet configured to define a storage space; a door configured to open and close the storage space, wherein the door includes: a panel assembly including a front panel and an insulating panel spaced apart from the front panel; a door frame connected to the panel assembly; a door liner configured to define an insulating space, in which an insulator is disposed, together with the panel assembly and the door frame; and a sensor module installed on the door frame, wherein the door frame includes a front wall, which is in contact with a rear surface of the front panel, and a mounting portion provided on the front wall, and the sensor module includes a sensor PCB, which is mounted on the mounting portion and has a front surface that is in contact with the front wall, and a sensor element installed on a rear surface of the sensor PCB.

The details of one or more embodiments are set forth in the accompanying drawings and the description below. Other features will be apparent from the description and drawings, and from the claims.

DETAILED DESCRIPTION OF THE EMBODIMENTS

Figure 1:
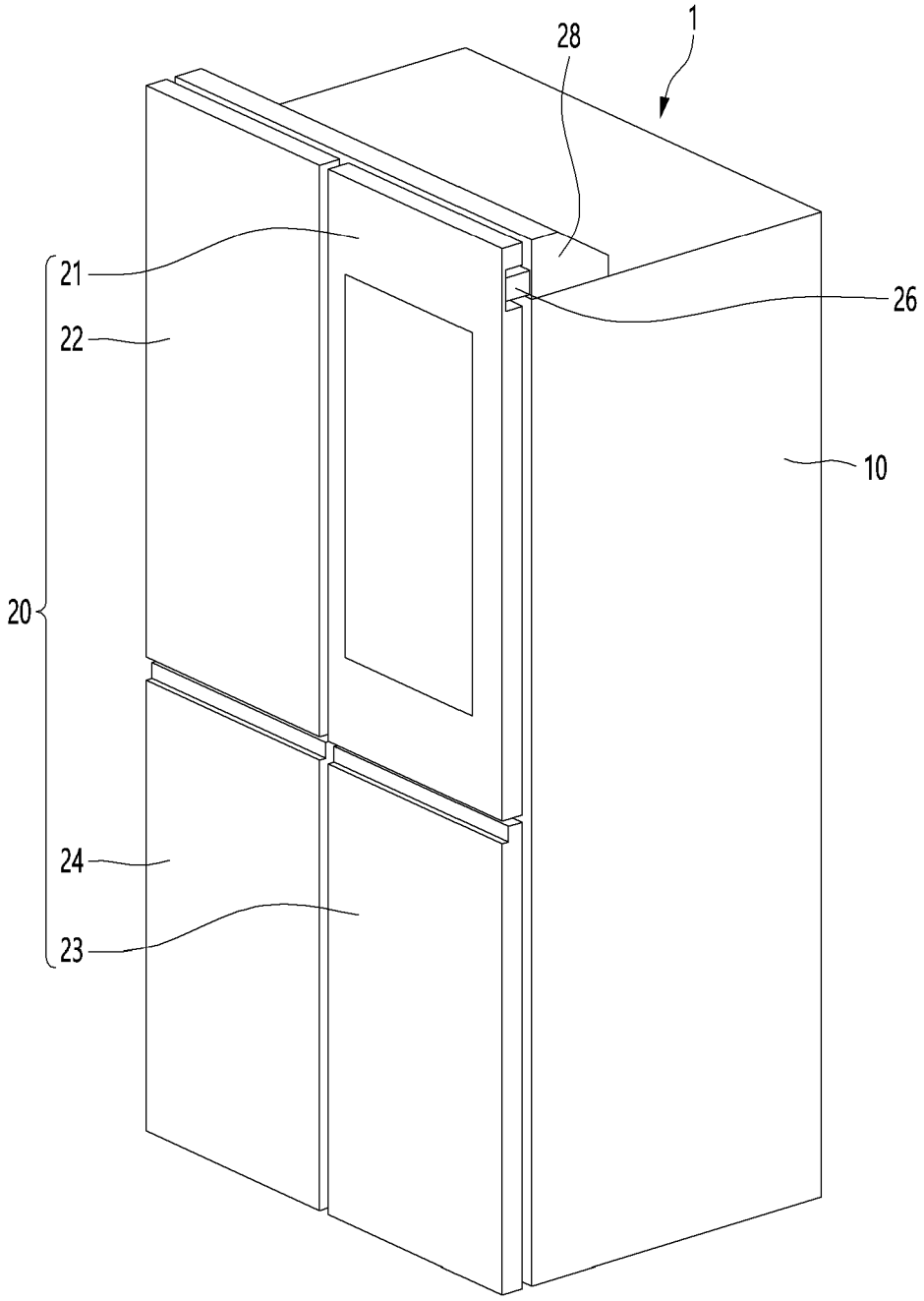
FIG. 1 is a perspective view illustrating a refrigerator according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a perspective view illustrating a refrigerator according to an embodiment.

Referring to FIG. 1, a refrigerator 1 according to this embodiment may include a cabinet 10 defining a storage space and a refrigerator door 20 opening and closing the storage space.

The storage space may include a plurality of storage areas, and the plurality of storage areas may be arranged in a vertical direction or a left and right direction.

The number of refrigerator doors 20 may vary according to the number of storage areas. For example, when the plurality of storage areas are arranged in the vertical direction, the first storage area doors 21 and 22 may open and close the upper first storage area, and the second storage area doors 23 and 23 may open and close the lower second storage area. The first storage area may be, for example, a refrigerating area, and the second storage area may be a freezing area, and vice versa.

In this case, one storage area may be opened and closed by one door or a plurality of doors in a rotating or sliding manner.

In FIG. 1, for example, the upper first storage area is opened and closed while the first storage area doors 21 and 22 arranged in the left and right directions rotate by a hinge 26. The hinge 26 may be at least partially covered by the hinge cover 28.

The first storage area doors 21 and 22 may include a left door and a right door.

Figure 2:
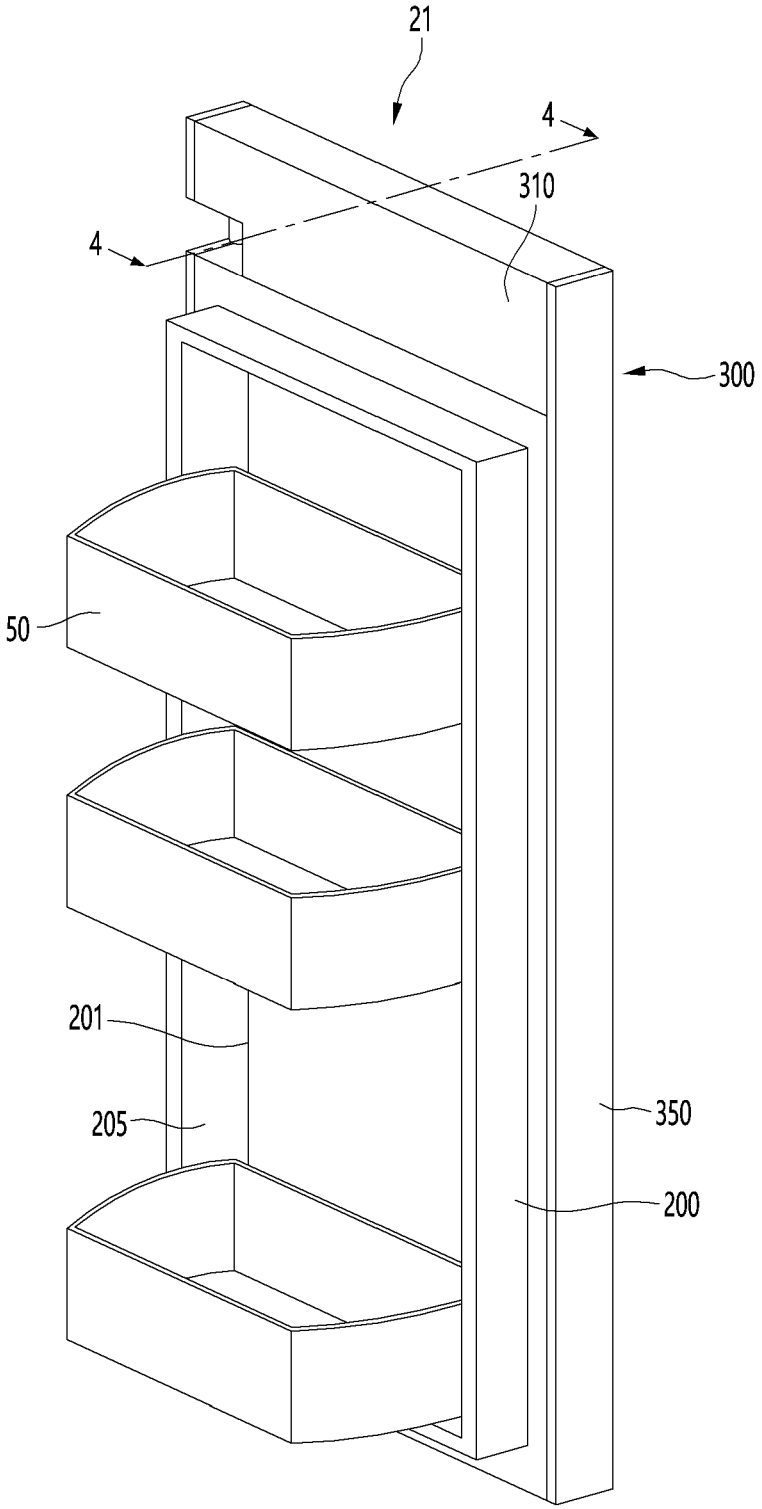
FIG. 2 is a rear perspective view of a first storage area door according to an embodiment.
Figure 3:
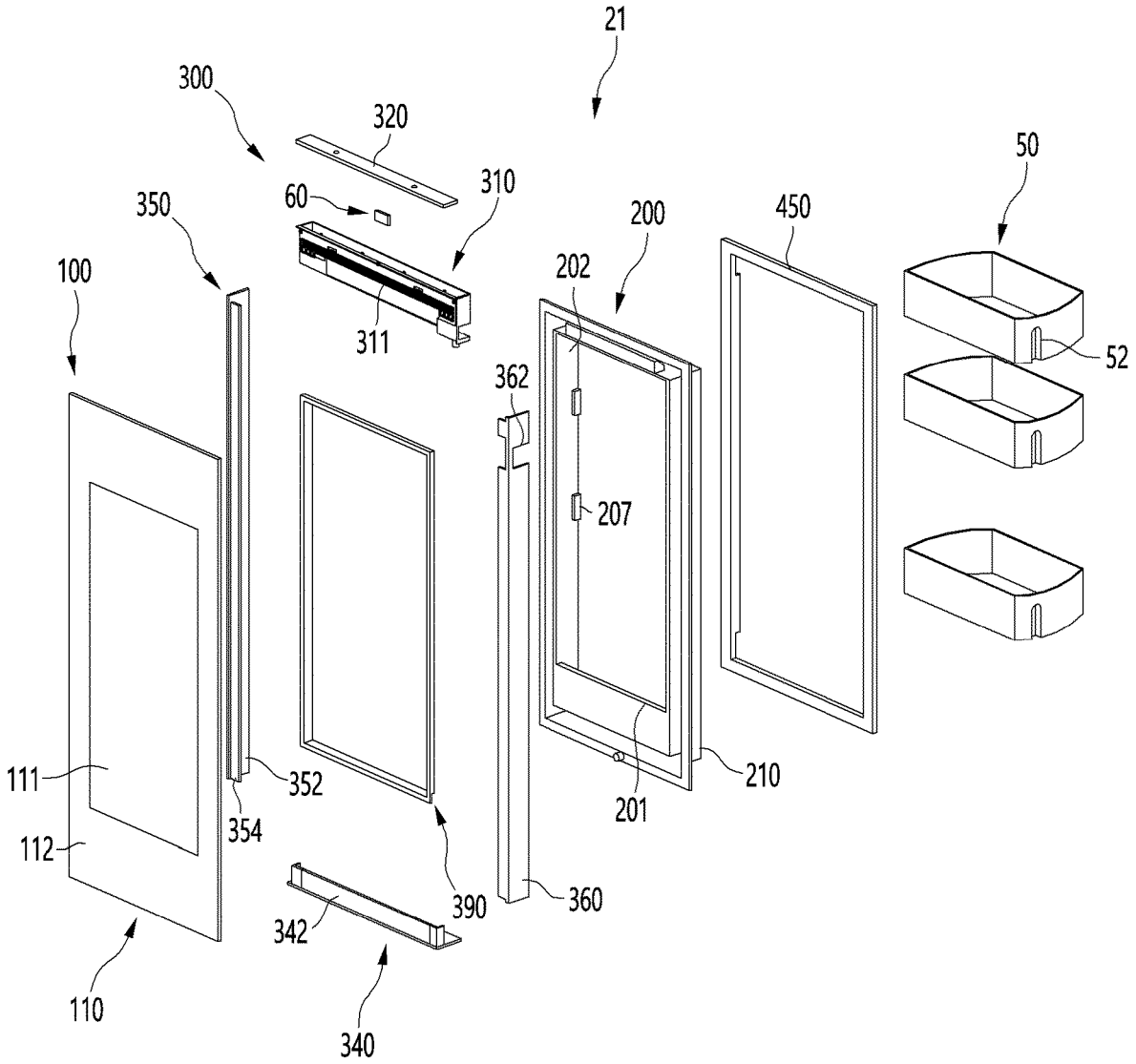
FIG. 3 is an explode perspective view of the first storage space door of FIG. 2.
Figure 4:
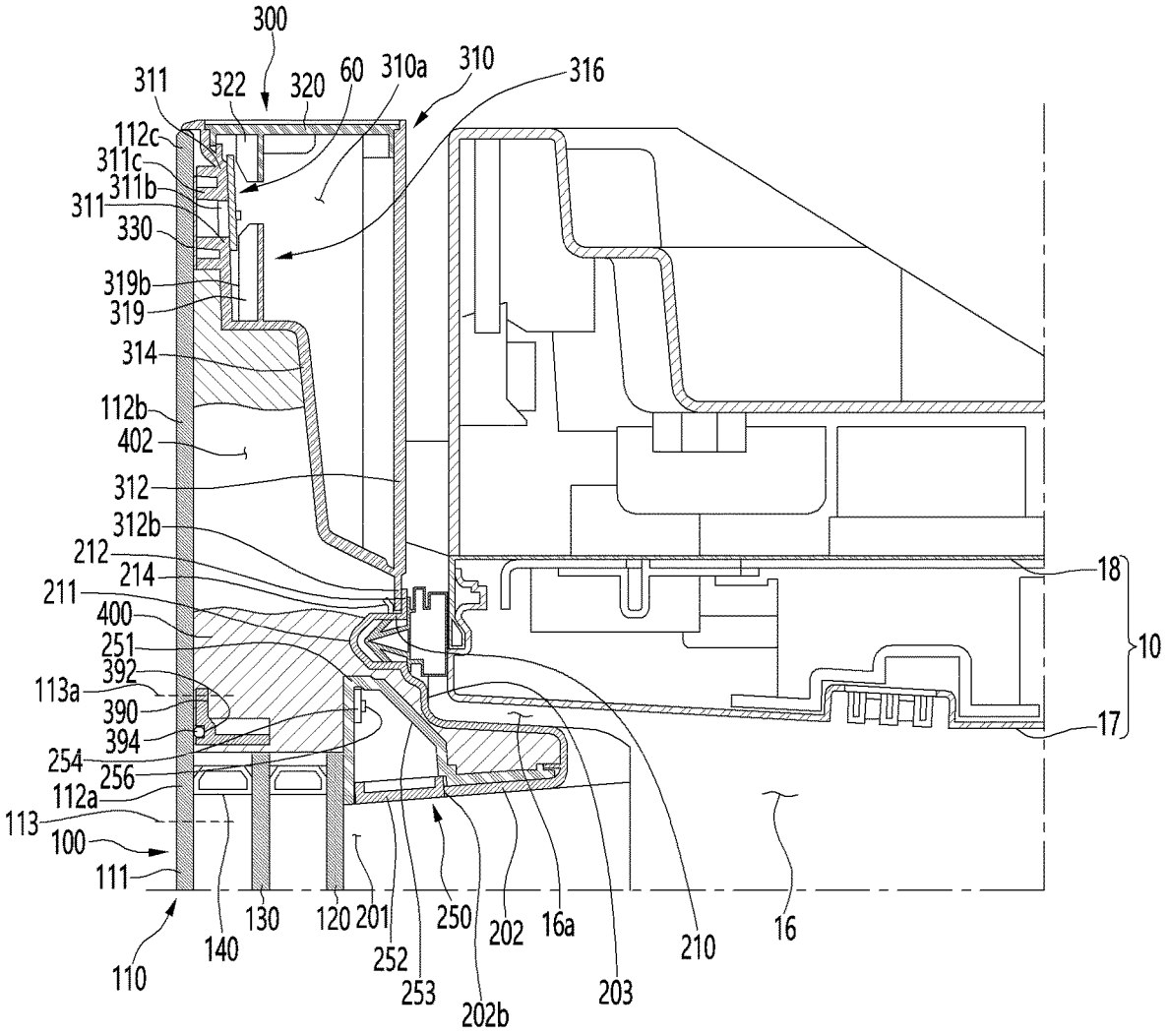
FIG. 4 is a cutaway cross-sectional view taken along line 4-4 of FIG. 2.

FIG. 2 is a rear perspective view of the first storage area door according to an embodiment, FIG. 3 is an explode perspective view of the first storage space door of FIG. 2, and FIG. 4 is a cutaway cross-sectional view taken along line 4-4 of FIG. 2. In FIG. 2, for example, a rear surface of the first storage area door disposed at the right side is illustrated.

Hereinafter, the right first storage area door will be described with reference to FIGS. 2 to 4.

The first storage area door 21 may be a single door, and when the first storage room door 21 rotates, the first storage area may be opened.

The first storage area door 21 includes a door frame 300 defining an outer appearance thereof, a panel assembly 100 coupled to the door frame 300, and a door liner 200 defining an insulating space 402, in which the insulator 400 is disposed, together with the door frame 300 and the panel assembly 100.

The door frame 300 may be provided or assembled in the shape of a rectangular frame having an opening, and at least one of the panel assembly 100 or the door liner 200 may cover the opening of the door frame 300.

The door liner 200 may include a liner opening 201. The panel assembly 100 may cover the liner opening 201.

The panel assembly 100 may include a front panel 110. The front panel 110 may define an outer appearance of a front surface of the first storage area door 21.

The front panel 110 may be made of a glass material or a transparent plastic material.

The front panel 110 may include a first portion 111 and a second portion 112 disposed outside the first portion 111. The second portion 112 may be disposed to surround the first portion 111.

A printed layer may be disposed along a circumference of an edge of a rear surface of the front panel 110, and the first portion 111 and the second portion 112 may be distinguished from each other by the printed layer. The printed layer may be referred to as a bezel. That is, a portion of the front panel 110 at which the printed layer is provided may be defined as the second portion 112.

The first portion 111 may be a portion through which light irradiated from a lighting unit 250 is transmitted, and the printed layer may restrict or block the light transmission through the second portion 112.

The panel assembly 100 may further include one or more insulating panels 120 and 130 disposed behind the front panel 110.

In FIG. 4, for example, two insulating panels are illustrated to be disposed behind the front panel 110, but one insulating panel may be disposed behind the front panel 110.

The insulating panels 120 and 130 may include the first insulating panel 120 and the second insulating panel 130.

The first insulating panel 120 may be disposed behind the front panel 110, and the second insulating panel 130 may be disposed between the front panel 110 and the first insulating panel 120.

A spacer 140 is provided between the front panel 110 and the second insulating panel 130, and an insulating space is provided between the front panel 110 and the second insulating panel 130. An insulating gas may be injected into the insulating space, or the insulating space may be in a vacuum state to define a vacuum insulating space.

A spacer 140 is provided between the second insulating panel 130 and the first insulating panel 120, and an insulating space is provided between the second insulating panel 130 and the first insulating panel 120. An insulating gas may be injected into the insulating space, or the insulating space may be in a vacuum state to define a vacuum insulating space.

Each of the insulating panels 120 and 130 may be made of a glass material or a transparent plastic material.

The spacer 140 may be disposed to face the second portion 112 so that the spacer 140 is not exposed to the outside.

A left and right width and a height of the front panel 110 may be greater than a left and right width and a height of the respective insulating panels 120 and 130.

Thus, the spacer 140 may be disposed at a position that is spaced a predetermined distance inward from an outer end of the front panel 110. That is, the spacer 140 may be disposed between a boundary line 113 between the first portion 111 and the second portion 112 and the outer end of the front panel 110.

The first storage area door 21 may further include a heater frame 390 attached to the rear surface of the front panel 110 by an adhesion portion. The heater frame 390 may be provided in the form of a rectangular frame, be disposed behind the front panel 110, and be disposed between the front panel 110 and the second insulating panel 130 outside the spacer 140 to surround the spacer 140. That is, the spacer 140 may be disposed in a region (or opening) defined by the heater frame 390.

A groove 392 accommodating a heater 394 may be defined in a front surface of the heater frame 390. The heater 394 may provide heat to the front panel 110 to prevent water droplets from being generated on the front panel 110. The heater frame 390 may be attached to a rear surface of the second portion 112 of the front panel 110 so that the heater frame 390 is not exposed to the outside.

The door frame 300 may be provided by a single frame or by assembling a plurality of frames.

The door frame 300 may be fixed to the rear surface of the front panel 110 by an adhesion portion 330. The adhesion portion 330 may be, for example, an adhesive or a double-sided tape.

The adhesion portion 330 may be disposed on the rear surface of the second portion 112 of the front panel 110 so that the adhesion portion 330 is not exposed to the outside.

In the state in which the door frame 300 is attached to the front panel 110, the door frame 300 may cover a circumferential surface (including a top surface, a bottom surface, and both side surfaces) of the front panel 110.

The door frame 300 may include an upper frame 310 (or a first frame), a lower frame 340 (or a second frame), and a pair of side frames 350 and 360 connecting the upper frame 310 to the lower frame 340.

Each of the side frames 350 and 360 may include a side surface portion 352 that is in contact with side surfaces of the upper frame 310 and the lower frame 340 and a front surface portion 354, which extends from the side surface portion 352 in a direction crossing the side surface portion 352 and is in contact with a front wall 311 of the upper frame 310 and a front wall 342 of the lower frame 340.

The front surface portion 354 may extend from the side surface portion 352 at a position spaced a predetermined distance backward from a front end of the side surface portion 352.

A front surface of the front surface portion 354 may adhere to a rear surface of the front panel 110 by the adhesion portion.

A rear surface of the front surface portion 354 may be in contact with front surfaces of the upper frame 310 and the lower frame 340 and be coupled to the upper frame 310 and the lower frame 340 by a coupling member such as, for example, a screw.

A slot 362 providing a space in which a hinge 26 is disposed may be provided in any one of the pair of side frames 350 and 360.

The door liner 200 may include an inner body 202 defining the liner opening 201. The inner body 202 includes a top surface, a bottom surface, and both side surfaces 205.

A coupling protrusion 207 coupled to a basket 50 may be provided on the inner body 202. For example, the coupling protrusion 207 may be provided on each of the both side surfaces 205. The plurality of coupling protrusions 207 disposed on both the side surfaces may be disposed to be spaced apart from each other in the vertical direction. A protrusion groove 52 that receives the coupling protrusion 207 may be defined in each of both side walls of the basket 50.

In a state in which the basket 50 is mounted on the door liner 200, at least a portion of the basket 50 may be disposed to face the first portion 111 of the front panel 110. Thus, when the lighting unit 250 operates while the first refrigerating compartment door 21 is closed, the basket 50 and the foods accommodated in the basket 50 may be visible from the outside by light passing through the first portion 111.

An end of the inner body 202 may be in contact with the panel assembly 100. For example, the end of the inner body 202 may be in contact with the rear surface of the first insulating panel 120. The first insulating panel 120 may cover the liner opening 201 defined by the inner body 202.

Here, the end of the inner body 202 may be in contact with a position spaced a predetermined distance inward from the outer end of the first insulating panel 120.

The door liner 200 may further include an outer body 210 and a connection body 203 connecting the outer body 210 to the inner body 202.

The door liner 200 may include a gasket coupling portion 211 to which the gasket 450 is coupled. The gasket coupling portion 211 may be provided in a recessed shape, and the outer body 210 and the connection body 203 may provide the gasket coupling portion 211.

The lighting unit 250 may be installed on the door liner 200. For example, the lighting unit 250 may be installed on the inner body 202.

An installation opening **202*b* in which a portion of the lighting unit 250 is disposed may be defined in the inner body 202**.

For example, the lighting unit 250 may include a case 251 and a cover 252 that covers the case 251.

The cover 252 may extend lengthily in the left and right direction along the door liner 200 and may be installed on the inner body 202. A portion of the cover 252 may be in contact with the first insulating panel 120.

The case 251 defines a space for accommodating a light emitting unit PCB (printed circuit board) 254 in which a plurality of light emitting units 256 are installed.

The case 251 includes a reflective surface 253 on which a surface facing the light emitting unit PCB 254 is rounded or inclined. The light irradiated from the light emitting unit 256 is reflected by the reflective surface 253 and is directed to the cover 252.

The cover 252 is provided to be transparent or translucent so that the light reflected from the reflective surface 253 and then spread may be transmitted.

For example, the light emitting unit 256 irradiates light in a direction away from the first insulating panel 120, and the irradiated light is reflected from the reflective surface 253 to passes through the cover 252 and then is transmitted toward the door liner 200.

The door liner 200 may further include a liner extension portion 212 that is bent around the outer body 210 to extend and is in contact with the door frame 300. The liner extension portion 212 may extend from the outer body 210 in a direction crossing the outer body 210.

The liner extension portion 212 may be in contact with a frame extension portion **312*b* provided on the rear wall 312 of the upper frame 310 and the rear wall 344 of the lower frame 340**.

The liner extension portion 212 and the frame extension portion **312*b* may adhere to each other by the adhesion portion. In this case, the adhesion portion may be provided on a portion or the whole of the contact portions between the liner extension portion 212 and the door frame 300. Alternatively, the liner extension portion 212 and the frame extension portion 312*b*** may be in contact with each other without the adhesion portion. In this embodiment, it will be defined and described that the two members are in contact with each other even when the two members are coupled to each other in a state in which the adhesion portion is disposed between the two members.

Also, the liner extension portion 212 may be in contact with a rear side of each of the side frames 350 and 360.

As described above, the insulating space 402, in which the insulator 400 is disposed may be defined by the door frame 300, the panel assembly 100, and the door liner 200.

An opening (not shown) for injecting a foaming liquid may be defined in the door frame 300 or the door liner 200. As the foaming liquid is injected through the opening, and the foaming liquid is cured, the insulator 400 may be disposed in the insulating space 402.

In the process of curing the foaming liquid, the foaming liquid is combined with a structure that is in contact with the foaming liquid. That is, the foaming liquid not only serves for insulation, but also serves as a connection portion that connects two spaced structures to each other.

For example, in FIG. 4, a portion of the insulator 400 may be disposed to surround the insulating panels 120 and 130 in the panel assembly 100, and in particular may be in contact with the first insulating panel 120. A portion of the insulator 400 that is in contact with the first insulating panel 120 is in contact with the inner body 202 of the door liner 200. Thus, the insulator 400 serves to connect the door liner 200 to the panel assembly 100.

Also, the other portion of the insulator 400 is in contact with the frame extension portion 312*b* of the upper frame 310 and the outer body 210 of the door liner 200. Thus, the insulator 400 connects the door liner 200 to the upper frame 310.

A rib 214 extending upward may be provided on a top surface of the outer body 210. The rib 214 is disposed to be spaced apart from the liner extension portion 212.

For example, the rib 214 may be disposed to be spaced apart from the liner extension portion 212 in a forward direction toward the front panel 110. A space, in which the frame extension portion 312*b* is disposed is defined in a gap between the rib 214 and the liner extension portion 212.

Thus, the frame extension portion 312*b* is seated on the outer body 210 between the rib 214 and the liner extension portion 212.

The cabinet 10 may include an inner case 17 defining a storage space 16 and an outer case 18 surrounding the inner case 101 and defining an outer appearance thereof.

The inner case 17 has an opened front surface, and the first storage area door 21 covers the opened front surface. A portion of the door liner 200 is disposed inside the storage space 16 when the first storage area door 21 closes the storage space 16. The front opening of the inner case 17 may be referred to as an inlet 16*a* of the storage space 16.

For example, a portion of the inner body 202 and a portion of the connection body 203 are disposed inside the storage space 16. On the other hand, the outer body 210 is disposed outside the storage space 16.

When the first storage area door 21 closes the storage space 16, a portion of each of the insulating panels 120 and 130 faces the storage space 16.

The first portion 111 of the front panel 110 is disposed to face the storage space 16. A first part 112*a* of the second portion 112 of the front panel 110 may be disposed to face the storage space 16, and a second part 112*b* disposed outside the first part 112*a* may be disposed so as not to face the storage space 16. (In FIG. 4, it may be understood that the first part 112*a* and the second part 112*b* are distinguished from each other the boundary line 113*a*)

Also, in the state in which the first storage area door 21 closes the storage space 16, a portion (a portion adjacent to the insulating panel in the panel assembly) of the insulating space 402 of the first storage area door 21 may be disposed to face the storage space 16, and other portion may be disposed so as not to face the storage space 16.

The first storage area door 21 may further include a sensor module 60 that senses a knock input applied to the front panel 110.

The sensor module 60 may sense the knock input, and when the sensed knock input is an effective knock input, the lighting unit 250 may operate while the first storage area door 21 is closed.

The sensor module 60 may be disposed as far from the inlet 16*a* of the storage space 16 as possible so that an influence of cold air in the storage space 16 is minimized.

For example, the sensor module 60 may be installed on the upper frame 310.

The upper frame 310 defines the insulating space 402, and a portion of the upper frame 310 is disposed radially outside the insulating space 402 when viewed from the first storage area door 21 as a whole.

The upper frame 310 includes the front wall 311 and a rear wall 312 disposed to face the front wall 311.

The front wall 311 may include a first portion facing the front panel and a second portion disposed at a side that is opposite to the first portion. The second portion may face the rear wall 312.

A vertical length of the front wall 311 is less than that of the rear wall 312. A lower end of the front wall 311 is disposed higher than a lower end of the rear wall 312. A lower side of the front wall 311 and a lower side of the rear wall 312 may be connected to each other by a connection wall 314.

The front wall 311 may include a protrusion rib 311*a* protruding forward. The protrusion rib 311*a* may protrude toward the front panel from the first portion of the front wall 311. The protrusion rib 311*a* may be attached to the rear surface of the front panel 110 by the adhesion portion 330. That is, the front wall 311 may be in contact with the rear surface of the front panel 110.

Here, a plurality of protrusion ribs 311*a* may be disposed to be spaced apart from each other in the vertical direction, and each of the protrusion ribs 311*a* may extend lengthily in the horizontal direction.

When the plurality of protrusion ribs 311*a* are provided, a contact area with the front panel 110 may increase, and thus, coupling force between the upper frame 310 and the front panel 110 may increase.

Referring to FIG. 4, a portion of the insulating space 402 may be disposed in a space between the rear surface of the front panel 110 and a portion of the front wall 311, and the other portion of the insulating space 402 may be disposed between the connection wall 314 and the rear surface of the front panel 110.

One surface (the first portion) of the front wall 311 and one surface of the connection wall 314 may define the insulating space 402, and the other surface (the second part) of the front wall 311 and the other surface of the connection wall 314 may define the accommodation space 310*a*.

When the first storage area door 21 is closed, the front wall 311 may be disposed higher than the outer case 18. Also, the upper portion 112*c* of the second portion 112 may be disposed higher than the outer case 18. The upper portion 112*c* of the second portion 112 is substantially an upper portion 112*c* of the second part 112*b*.

The upper portion 112*c* of the second portion 112 is a portion of the second part 112*b*. The front wall 311 may be in contact with a rear surface of the upper portion 112*c* of the second portion 112.

The sensor module 60 may be installed on the front wall 311 in the upper frame 310. When the sensor module 60 is installed on the front wall 311, the sensor module 60 may face the protrusion rib 311*a*. That is, the sensor module 60 may be disposed to face the second part 112*b* of the second portion 112.

Figure 5:
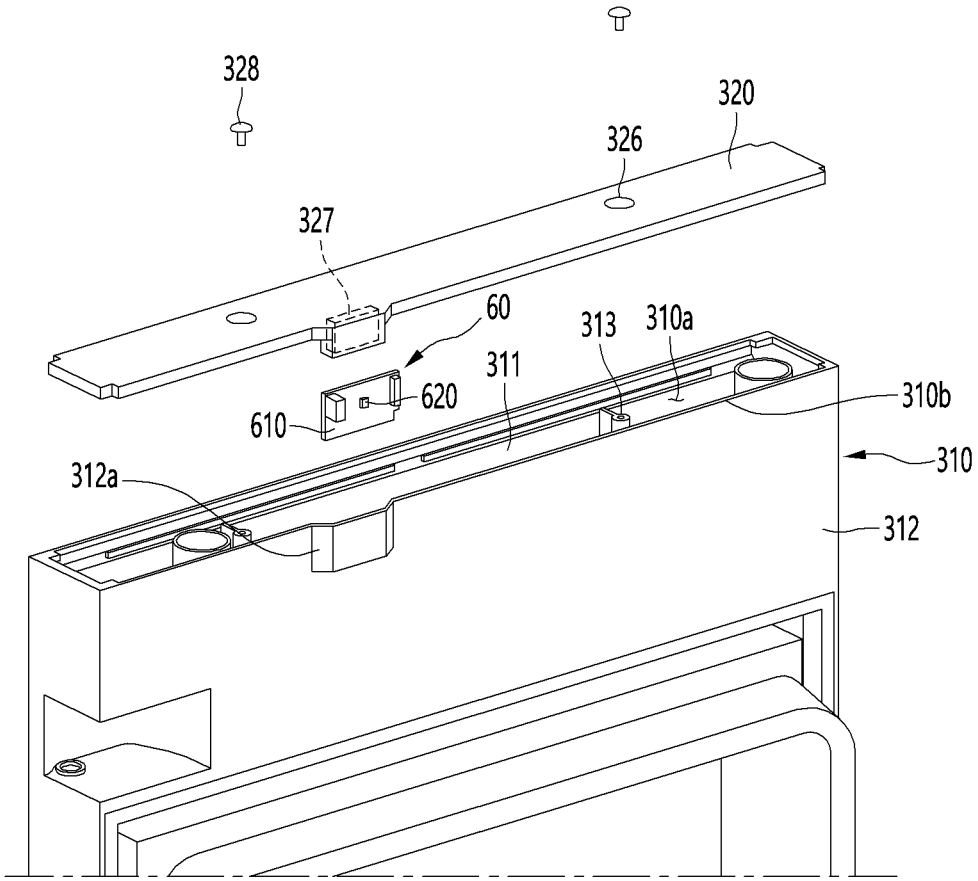
FIG. 5 is a view illustrating a state in which a sensor module is separated from an upper frame.
Figure 6:
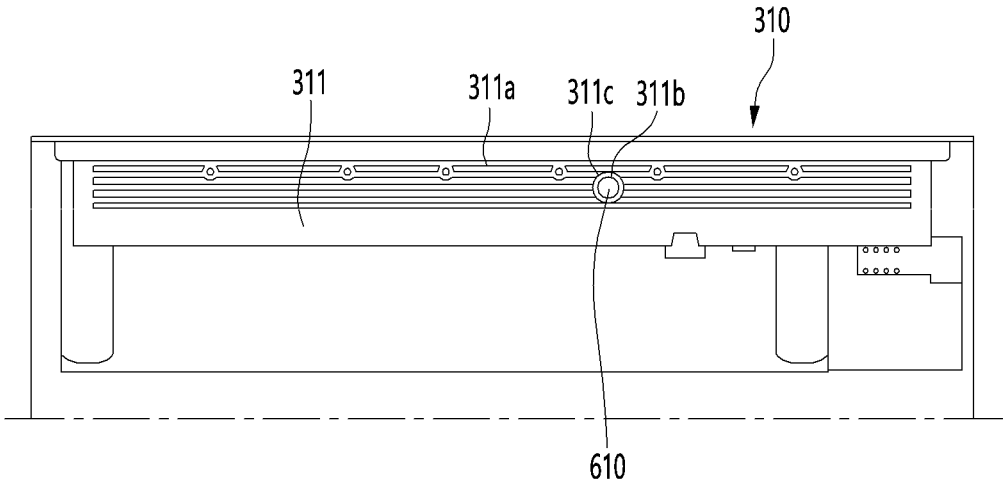
FIG. 6 is a front view of the upper frame on which the sensor module is mounted.

FIG. 5 is a view illustrating a state in which the sensor module is separated from the upper frame, and FIG. 6 is a front view of the upper frame on which the sensor module is mounted.

Figure 7:
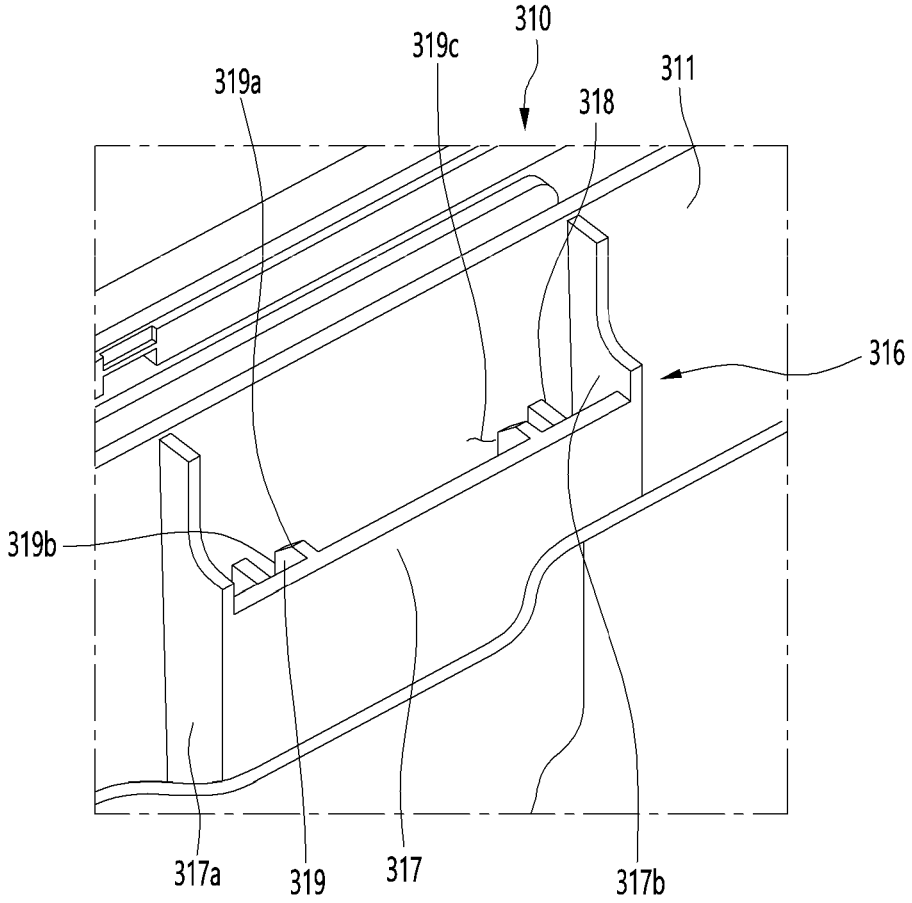
FIG. 7 is a view of a module mounting portion, on which the sensor module is mounted, on the upper frame.
Figure 8:
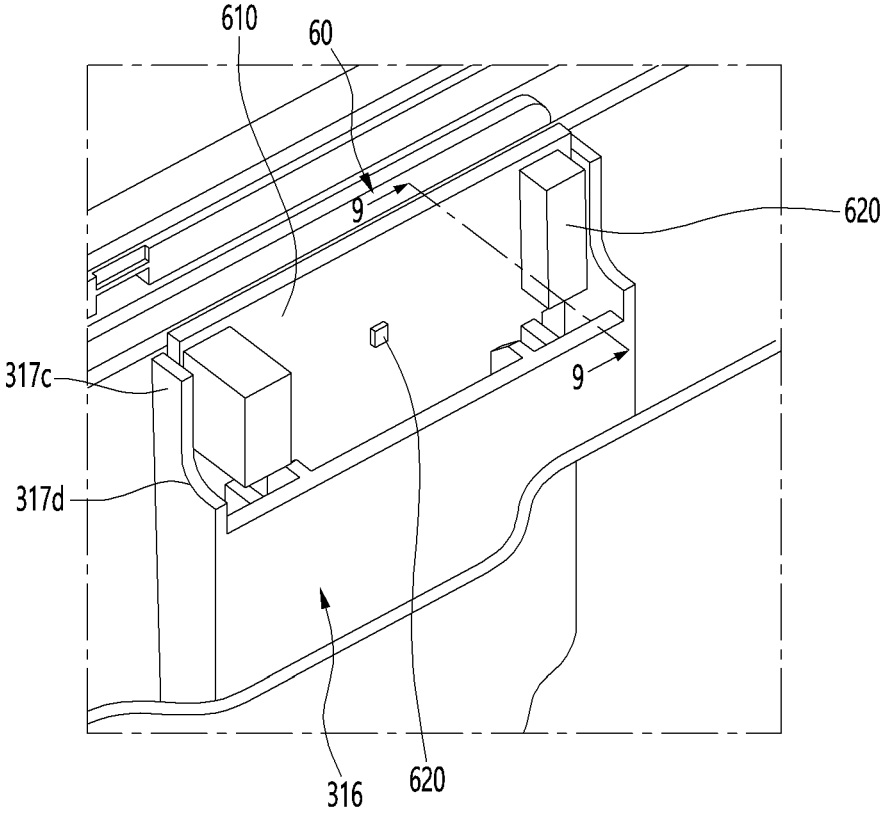
FIG. 8 is a view illustrating a state in which the sensor module is mounted on a mounting portion of the upper frame.
Figure 9:
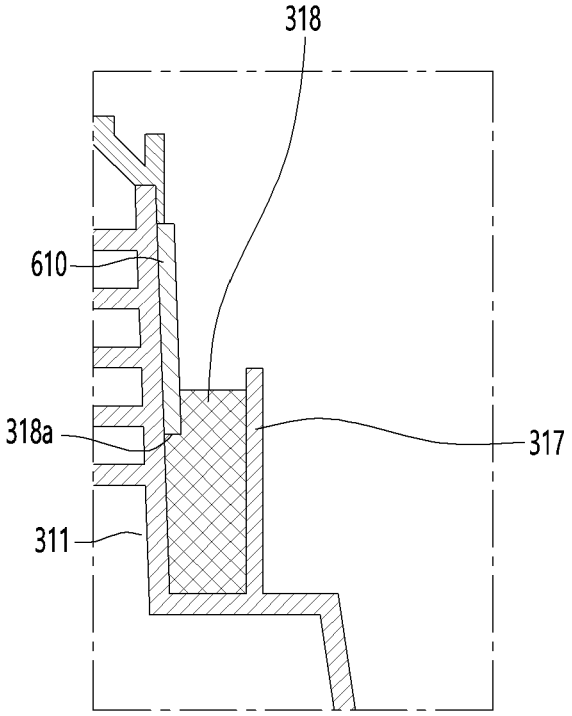
FIG. 9 is a cutaway cross-sectional view taken along line 9-9 of FIG. 8.

FIG. 7 is a view of a module mounting portion, on which the sensor module is mounted, on the upper frame, and FIG. 8 is a view illustrating a state in which the sensor module is mounted on a mounting portion of the upper frame. FIG. 9 is a cutaway cross-sectional view taken along line 9-9 of FIG. 8.

Referring to FIGS. 4 to 9, the upper frame 310 may include an accommodation space 310*a* in which the sensor module 60 is accommodated. The upper frame 310 may include an opening 310*b*. Thus, the sensor module 60 may be accommodated in the accommodation space 310*a* through the opening 310*b*. The accommodation space 310*a* may be partitioned from the insulating space 402 and may be disposed outside the insulating space 402.

The accommodation space 310*a* may be covered by a frame cover 320 coupled to the upper frame 310. The upper frame 310 may include a coupling boss 313 coupled to the frame cover 320, and a coupling hole 326, through which the coupling member 328 passes may be defined in the frame cover 320.

A magnet 327 used to sense the opening and closing of the first storage area door 21 may be provided on the frame cover 320. The magnet 327 may act with a reed switch (not shown) provided in the cabinet 10.

A protruding wall 312*a* defining a space in which the magnet 327 is disposed may be provided on the rear wall 312 of the upper frame 310.

The sensor module 60 may include a sensor element 620 and a sensor PCB (printed circuit board) 610 on which the sensor element 620 is installed.

The sensor element 620 may be, for example, an acceleration sensor. When a knock is applied to the front surface of the front panel 110, vibration is generated in the front panel 110 by the knock, and the vibration generated in the front panel 110 is transmitted to the acceleration sensor through the front wall 311 of the upper frame 310 and the sensor PCB 610. Thus, the acceleration sensor may also be understood as a vibration sensor.

When an intensity of the vibration generated by knocking two or more times within a predetermined time is equal to or greater than a reference intensity, it is determined as an effective knock input, and in this case, the lighting unit 250 may operate.

A mounting portion 316 on which the sensor module 60 is mounted may be provided on the front wall 311.

The sensor PCB 610 may be mounted on the mounting portion 316 in an upright state. The sensor PCB 610 may be mounted on the mounting portion 316 in the vertical direction. In the state in which the sensor PCB 610 is mounted on the mounting portion 316, the sensor element 620 may be disposed between the sensor PCB 610 and the rear wall 312.

For example, a front surface of the sensor PCB 610 may face the front wall 311, and the sensor element 620 may be installed on the rear surface of the sensor PCB 610.

In this embodiment, since the sensor element 620 determines whether the knock input is the effective knock input by sensing the vibration, the vibration greater than or equal to a reference level has to be transmitted to the sensor element 620.

In this embodiment, a portion of the second portion 112 of the front panel 110 is in contact with the insulator 400, and the other portion is not in contact with the insulator 400. A portion of the front panel 110, which is in contact with the insulator 400, is in a state of being coupled to the insulator 400, the front panel 110 is provided in one body together with the insulator 400. Thus, when the knocking is applied to the front panel 110, the insulator absorbs the vibration at the portion that is in contact with the insulator 400 of the front panel 110, and thus, the intensity of the vibration is not large.

On the other hand, the portion of the front panel 110 that is not in contact with the insulator 400 has relatively greater vibration when compared to the vibration at the portion that is in contact with the insulator 400. That is, the portion of the front panel 110 that is not in contact with the insulator 400 serves as a free end at which the vibration occurs due to the vibration.

In this embodiment, since a portion of the second portion 112 in the front panel 110 serves as the free end, the intensity of the vibration of the portion of the second portion 112 is large. Thus, when the sensor module 60 is disposed on an area corresponding to a portion of the second portion 112, an intensity of the vibration in the sensor element 620 (actually, an acceleration change value according to the vibration is output in the sensor element) is greater than the reference intensity may be sensed.

A through-hole 311*b* may be provided in the front wall 311. The through-hole 311*b* may be defined to face the sensor PCB 610.

The through-hole 311*b* may be disposed to face the sensor element 620 of the sensor PCB 610. The through-hole 311*b* may be provided, for example, in a circular shape, but is not limited thereto. A diameter of the through-hole 311*b* may be greater than that of the sensor element 620. The diameter of the through-hole 311*b* may be less than each of the left and right length and the vertical length of the sensor PCB 610.

A circumferential wall 311*c* may be provided around the through-hole 311*b* on the front wall 311*b*. The circumferential wall 311*c* may be provided, for example, in a cylindrical shape having a hollow therein and may be in direct or indirect contact with the rear surface of the front panel 110.

Air may be disposed in a space defined by the through-hole 311*b* and the circumferential wall 311*c*. The air serves as a medium for transmitting the vibration of the front panel 110 to the sensor PCB 610.

In this embodiment, the vibration generated by the knock applied to the front panel 110 is not only transmitted to the sensor PCB 610 by the front wall 311 that is in contact with the front panel 110, but also transmitted to the sensor PCB 610 by the air. The amount of vibration transmitted to the sensor element 620 may be maximized.

For example, the sensor element 620 may sense vibration of a first axis and/or a second axis by the vibration transmitted to the sensor PCB 610 by the front wall 311 and also sense vibration of a third axis by the vibration transmitted to the sensor PCB 610 by the air in addition to the first axis and the second axis.

Thus, according to this embodiment, the sensor module 60 may effectively sense the vibration generated by the knock applied to the front panel 110 while reducing the influence of the cold air in the storage space 16.

In the state in which the sensor PCB 610 is mounted on the mounting portion 316, a lower end of the sensor PCB 610 is disposed higher than the uppermost end of the insulating space 402. That is, in the state in which the sensor module 60 is mounted on the mounting portion 316, a distance between the sensor module 60 and each of the insulating panels 120 and 130 may be greater than that between the outermost portion, which is disposed farthest away from each of the insulating panels 120 and 130, and each of the insulating panels 120 and 130 in the insulating space 402.

In the state in which the sensor PCB 610 is mounted on the mounting portion 316, the lowermost end of the sensor element 620 is disposed higher than the uppermost end of the insulating space 402.

When the sensor PCB 610 is mounted on the mounting portion 316, the lower end of the sensor element 620 is disposed higher than the lower end of the sensor PCB 610.

In the state in which the sensor PCB 610 is mounted on the mounting portion 316, the sensor PCB 610 is spaced apart from the connection body 203.

The sensor PCB 610 may be slidably mounted on the mounting portion 316. For example, the sensor PCB 610 may be slidably mounted on the mounting portion 316 while moving downward from an upper side through the opening 310*b* of the upper frame 310.

The mounting portion 316 may include a pair of extension portions 317*a* and 317*b* extending backward from the rear surface of the front wall 311 and spaced apart from each other in the horizontal direction and a connection portion 317 connecting the pair of extension portions 317*a* and 317*b* to each other.

A distance between the pair of extension portions 317*a* and 317*b* may correspond to a left and right width of the sensor PCB 610. Thus, when the sensor PCB 610 is mounted on the mounting portion 316, both sides of the sensor PCB 610 may be in contact with the pair of extension portions 317*a* and 317*b*. Thus, the horizontal movement of the sensor PCB 610 may be restricted.

Each of the extension portions 317*a* and 317*b* may include a first extension part 317*c* extending from the front wall 311 and a second extension part 317*d* extending form the first extension part 317*c* and having a height greater than that of the first extension part 317*c*.

An upper end of the second extension part 317*d* is disposed lower than an upper end of the first extension part 317*c*. The connection portion 317 may connect both ends of the second extension part 317*d*. An upper end of the connection portion 317 may be disposed at a position that is equal to or lower than that of the upper end of the second extension part 317*d*.

The mounting portion 316 may further include a support portion 318 that supports a lower side of the sensor PCB 610.

The support portion 318 may connect the front wall 311 to the connection portion 317 and may include a seating groove 318*a* in which the sensor PCB 610 is seated. The seating groove 318*a* may be defined as a top surface of the support portion 318 is recessed downward.

A lower end of the sensor PCB 610 may be inserted into the seating groove 318*a*. In the state in which the sensor PCB 610 is seated in the seating groove 318*a*, the sensor PCB 610 may be in contact with the rear surface of the front wall 311.

The mounting portion 316 may further include a pressing rib 319 that presses the sensor PCB 610 toward the front wall 311.

The pressing rib 319 may be provided on the connection portion 317. The pressing rib 319 extends from the connection portion 317 toward the front wall 311 and is spaced apart from the front wall 311.

Thus, the sensor PCB 610 may be substantially accommodated in a gap 319*c* defined between the front wall 311 and the pressing rib 319.

An inclined surface 319*a* is provided on an upper portion of the pressure rib 319 facing the front wall 311 so that the sensor PCB 610 is easily accommodated in the gap 319*c*. The inclined surface 319*a* is inclined in a direction away from the front wall 311 upward from the lower side.

In this embodiment, for example, a plurality of pressing ribs 319 may be disposed to be spaced apart from each other in the horizontal direction. The plurality of pressing ribs 319 may be spaced apart from the pair of extension portions 317*a* and 317*b*.

An upper end of the pressing rib 319 may be disposed at a height that is equal to or lower than that of an upper end of the connection portion 317. Thus, it is possible to prevent the pressing rib 319 from interfering with the sensor element 620.

In the state in which the sensor PCB 610 is inserted into the gap 319*c* to a predetermined depth, the sensor PCB 610 is seated in the seating groove 318*a* of the support portion 318. In this state, the pressing rib 319 may press the rear surface of the sensor PCB 610.

For example, a portion or the whole of the gap 319*c* may decrease in size from the upper side to the lower side. That is, a distance between the front wall 311 and the pressing rib 319 may be variable.

To reduce the size of the gap 319*c*, at least one of the first surface 319*b* facing the front wall 311 or the front wall 311 on the pressing rib 319 may be inclined with respect to a vertical line.

For example, the first surface 319*b* of the pressing rib 319 may be parallel to the vertical line, and at least a portion of the front wall 311 may be gradually inclined in a direction closer to the first surface 319*b* of the pressing rib 319 as it goes downward.

Alternatively, at least a portion of the front wall 311 may be parallel to the vertical line, and at least a portion of the first surface 319*b* of the pressing rib 319 may be gradually inclined in a direction toward the front wall 311 as it goes downward.

Alternatively, each of at least a portion of the front wall 311 and at least a portion of the first surface 319*b* of the pressing rib 319 may be inclined toward the lower side.

In either case, when the sensor PCB 610 is inserted into the gap 319*c* to the predetermined depth, the lower end of the sensor PCB 610 is seated in the seating groove 318*a*, the front surface of the sensor PCB 610 is in contact with the front wall 311, and the rear surface of the sensor PCB 610 is in contact with the first surface 319*b* of the pressing rib 319. Thus, the forward and backward movement and downward movement of the sensor PCB 610 are restricted.

According to this embodiment, since the position of the sensor PCB 610 is fixed only by slidably mounting the sensor PCB 610 on the mounting portion 316, the sensor module 60 may be easily mounted or separated to improve serviceability.

Particularly, when the frame cover 320 is separated from the upper frame 310, the sensor module 60 may be exposed to the outside, and thus, a user may easily access the sensor module 60.

Figure 10:
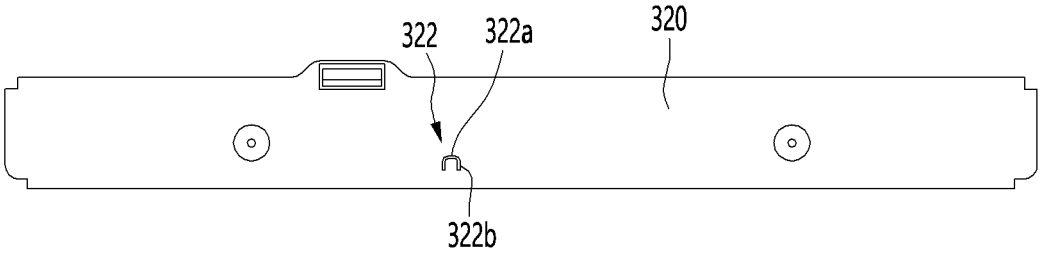
FIG. 10 is a bottom view of a frame cover.
Figure 11:
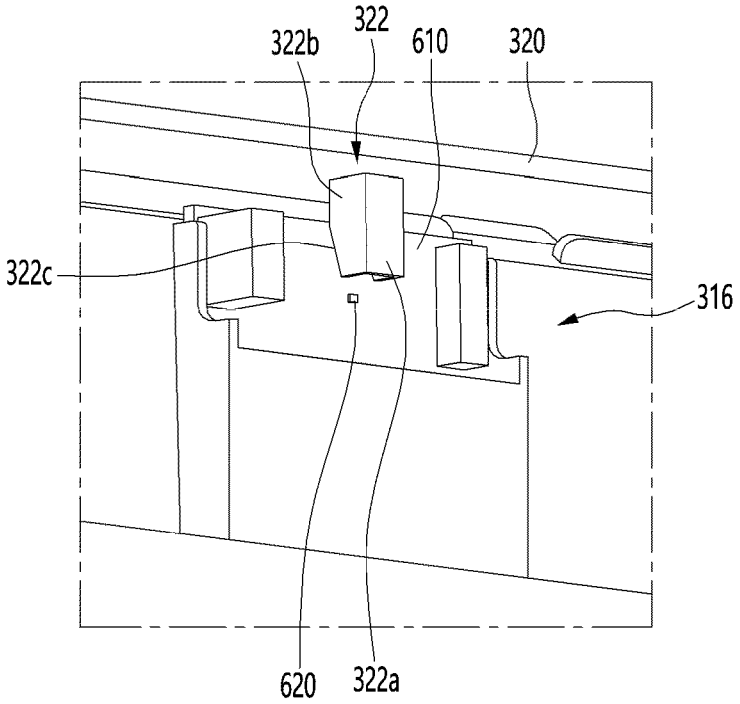
FIG. 11 is a view illustrating a state in which a sensor pressing portion of the frame cover is disposed behind the sensor module.
Figure 12:
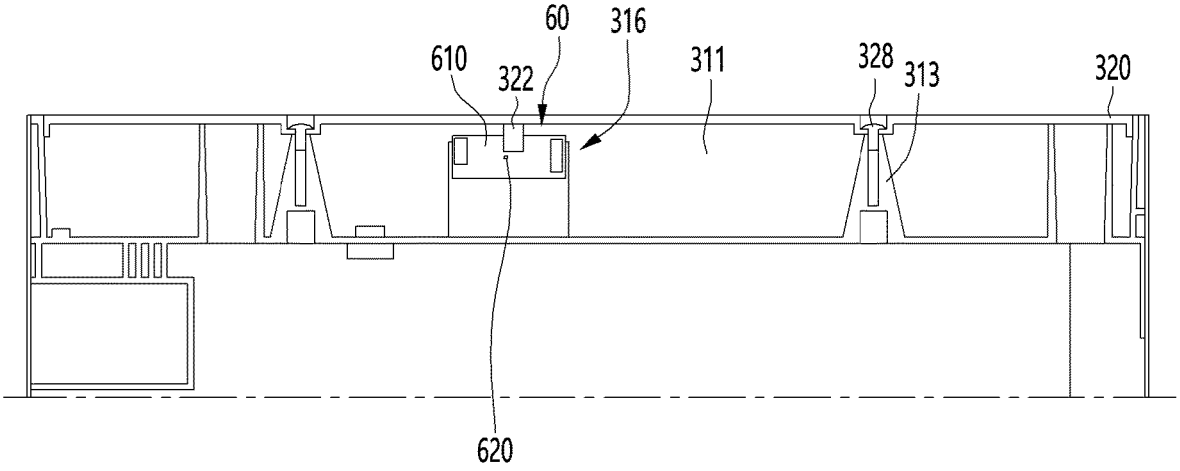
FIG. 12 is a cross-sectional view illustrating a state in which the sensor module is mounted on the upper frame.

FIG. 10 is a bottom view of the frame cover, FIG. 11 is a view illustrating a state in which a sensor pressing portion of the frame cover is disposed behind the sensor module, and FIG. 12 is a cross-sectional view illustrating a state in which the sensor module is mounted on the upper frame.

Referring to FIGS. 10 to 12, a sensor pressing portion 322 for restricting the separation of the sensor module 60 mounted on the mounting portion 316 or the backward movement of the sensor module 60 may be provided on a bottom surface of the frame cover 320.

When the frame cover 320 is coupled to the upper frame 310, the sensor pressing portion 322 may be in contact with the rear surface of the sensor PCB 610. When the sensor pressing portion 322 is in contact with the sensor PCB 610, the state in which the sensor PCB 610 is in contact with the front wall 311 may be maintained.

Thus, the sensor pressing portion 322 restricts the backward movement of the sensor PCB 610. To prevent the sensor pressing portion 322 and the sensor element 620 from interfering with each other, in the state in which the sensor pressing portion 322 is in contact with the sensor PCB 610, the sensor element 620 may be disposed below the sensor pressing portion 322.

The sensor pressing portion 322 may include a first extension rib 322*a* extending downward from a bottom surface of the frame cover 320 and a plurality of second extension ribs 322*b* extending from the first extension rib 322*a* in the direction crossing the first extension rib 322*a*.

The first extension rib 322*a* is disposed to face the rear surface of the sensor PCB 610, and the second extension rib 322*b* extends from the first extension rib 322*a* toward the rear surface of the sensor PCB 610.

For example, the plurality of second extension ribs 322*b* are spaced apart in the left and right direction and respectively extend from both ends of the first extension rib 322*a*.

The inclined surface 322*c* is provided on a surface of each of the second extension ribs 322*b*, which faces the sensor PCB 610.

The inclined surface 322*c* may be inclined so as to be away from the front wall 311 or the rear surface of the sensor PCB 610 as it moves away from the insulating panels 120 and 130.

For example, the inclined surface 322*c* is inclined to move away from the rear surface of the sensor PCB 610 downward from the upper side.

Thus, when the sensor pressing portion 322 is inserted into the upper frame 310 in the process of coupling the frame cover 320 to the upper frame 310, the sensor pressing portion 322 may be prevented from interfering with the sensor PCB 610 by the inclined surface 322*c*.

According to this embodiment, a knock signal may be sensed even when the sensor module is spaced apart from the front panel.

According to this embodiment, since the sensor module for sensing the knock is disposed radially outside the insulating space, the sensor module may be prevented from being deteriorated in sensing accuracy.

According to this embodiment, since the vibration applied to the front panel is not only transmitted to the sensor module through the front wall that is in contact with the front panel, but also transmitted to the sensor module by the air, the sensing accuracy of the sensor module may be improved.

According to this embodiment, when a service of the sensor module is required, the sensor module may be easily accessible and be easily replaced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage space; and a door configured to open and close at least a portion of the storage space, wherein the cabinet comprises:

an inner case that defines the storage space, and an outer case that surrounds the inner case and defines an outer appearance of the cabinet, wherein the door comprises:

a panel assembly comprising:

a front panel that defines a front surface of the door and is made of transparent tempered glass, an upper end of the front panel being disposed above than the outer case, an insulation panel spaced apart from the front panel and made of glass material, and a spacer that is coupled between the front panel and the insulation panel and defines a first space, an upper frame that defines an upper surface of the door and is connected to the panel assembly, a lower frame that defines a lower surface of the door and is connected to the panel assembly, a side frame that defines a side surface of the door and is connected to the panel assembly, a door liner that is coupled to the insulation panel and defines a liner opening, and an insulation material provided in a second space that is defined by the panel assembly, the upper frame, the lower frame, the side frame, and the door liner, wherein the upper frame comprises:

a front wall disposed above the outer case and supported on the front panel, a rear wall supported on the door liner, wherein a vertical length of the rear wall is greater than a vertical length of the front wall, and a lower end of the rear wall is disposed below a lower end of the front wall, and a protruding wall that is disposed at the rear wall of the upper frame and defines a third space, and wherein the refrigerator further comprises:

a magnet disposed within the third space, and a reed switch disposed at the cabinet and configured to detect opening and closing of the door based on sensing the magnet.

2. The refrigerator of claim 1, wherein the upper frame further comprises a connection wall that connects a lower side of the front wall and a lower side of the rear wall to each other.

3. The refrigerator of claim 1, wherein the front wall comprises protruding ribs protruding forward from the front wall and supported on a rear surface of the front panel.

4. The refrigerator of claim 1, wherein the door liner comprises:

a gasket coupling portion recessed toward the second space and coupled to a gasket; and a rib protruding from the gasket coupling portion and supported on the rear wall of the upper frame.

5. The refrigerator of claim 1, wherein the rear wall comprises a frame extension portion that is provided at a lower portion of the rear wall and contacts the door liner.

6. The refrigerator of claim 1, wherein the upper frame further comprises a frame cover that shields the third space and defines the upper surface of the door, and wherein the magnet is provided on the frame cover.

7. The refrigerator of claim 2, wherein the third space is separated from the second space by the connection wall, the front wall, and the rear wall.

8. The refrigerator of claim 1, wherein the upper frame has an opening configured to receive a foaming liquid injected into the second space.

9. The refrigerator of claim 1, further comprising, a hinge disposed at an upper surface of the cabinet and configured to rotate the door with respect to the cabinet; and a hinge cover disposed at the upper surface of the cabinet and configured to shield the hinge, wherein the hinge cover is positioned behind the rear wall of the upper frame and the front panel.

10. The refrigerator of claim 1, wherein the cabinet has an additional storage space in a lower portion of the cabinet, and wherein the storage space is positioned on an upper portion of the cabinet such that the storage space is visible through the panel assembly based on a lighting unit operating while the door is closed.

11. The refrigerator of claim 10, wherein the front panel comprises:

a first portion configured to transmit light from the lighting unit; and a second portion that surrounds the first portion and has a printed layer.

12. The refrigerator of claim 1, wherein the insulation panel comprises:

a first insulation panel spaced apart from the front panel; and a second insulation panel spaced apart from the first insulation panel, and wherein the spacer comprises (i) a first spacer disposed between the front panel and the first insulation panel and (ii) a second spacer disposed between the first insulation panel and the second insulation panel.

13. The refrigerator of claim 11, further comprising, a heater frame attached to a rear surface of the second portion of the front panel by an adhesion portion; and a heater provided in a front surface of the heater frame and configured to provide heat to the front panel to prevent water droplets from being generated on the front panel.

14. The refrigerator of claim 1, wherein the side frame comprises a first side frame and a second side frame, and wherein the upper frame comprises a side part to which the first side frame and the second side frame are coupled, respectively.

15. The refrigerator of claim 1, wherein the door liner comprises a coupling protrusion on which a basket is mounted, the coupling protrusion being disposed at a circumference of the door liner forming the liner opening.

16. The refrigerator of claim 11, wherein the front wall of the upper frame is in contact with a rear surface of an upper portion of the second portion, and wherein the upper portion of the second portion of the front panel is disposed higher than the outer case.

17. The refrigerator of claim 1, further comprising a sensor module configured to detect a knock input of a user applied to the front panel, the sensor module being disposed within the third space and spaced apart from the front panel.

18. The refrigerator of claim 17, wherein the front wall comprises a mounting portion on which the sensor module is mounted.

19. The refrigerator of claim 17, wherein the sensor module comprises a sensor element and a sensor printed circuit board (PCB) on which the sensor element is installed.

20. The refrigerator of claim 17, wherein the sensor module comprises an acceleration sensor to detect vibration generated by the knock input of the user applied to the front panel.

* * * * *